US011965347B1

(12) United States Patent
Horovitz

(10) Patent No.: US 11,965,347 B1
(45) Date of Patent: Apr. 23, 2024

(54) COMBINATION LEASH AND UMBRELLA HOLDER DEVICE

(71) Applicant: Alan Horovitz, Cranston, RI (US)

(72) Inventor: Alan Horovitz, Cranston, RI (US)

( * ) Notice: Subject to any disclaimer, the term of this patent is extended or adjusted under 35 U.S.C. 154(b) by 692 days.

(21) Appl. No.: 17/117,294

(22) Filed: Dec. 10, 2020

(51) Int. Cl.
*E04H 12/22* (2006.01)
*A45B 23/00* (2006.01)

(52) U.S. Cl.
CPC ..... *E04H 12/2223* (2013.01); *A45B 23/00* (2013.01); *A45B 2023/0012* (2013.01); *A45B 2200/1009* (2013.01)

(58) Field of Classification Search
CPC ..... A01K 1/04; E04H 12/2223; A45B 23/00; A45B 2023/0012; A45B 2200/1009
See application file for complete search history.

(56) References Cited

U.S. PATENT DOCUMENTS 429,111 A * 6/1890 Bailey ..... A01K 1/04 119/786
2,502,807 A * 4/1950 Temmer ..... A01K 1/04 248/156
3,293,809 A * 12/1966 Daline ..... E04H 17/22 52/157
4,546,730 A * 10/1985 Holland ..... A01K 5/0114 119/780
5,293,889 A * 3/1994 Hall ..... A45B 3/00 248/533
5,662,304 A 9/1997 McDaniel
5,957,092 A * 9/1999 Colsch ..... A01K 1/04 119/787
D421,532 S * 3/2000 Koroncai ..... D8/388
6,487,977 B1 * 12/2002 Williams ..... E04H 12/2223 108/150
7,264,210 B2 * 9/2007 Yu ..... E04H 12/2223 248/156
7,309,198 B1 * 12/2007 Brown ..... A01K 97/10 410/101
7,353,775 B1 * 4/2008 Stelmach ..... A01K 1/04 119/61.54
D593,315 S * 6/2009 Zemel ..... D3/10
8,656,651 B1 * 2/2014 Scarano, Jr. ..... E04H 12/2223 52/157
9,554,630 B1 * 1/2017 Patel ..... A45B 25/18
D877,486 S * 3/2020 Chen ..... D3/10
(Continued)

*Primary Examiner* — Tien Q Dinh
*Assistant Examiner* — Katelyn T Truong
(74) *Attorney, Agent, or Firm* — Salter & Michaelson

(57) ABSTRACT

A device for anchoring an object to a ground surface includes a hollow tubular member having respective upper end and lower end; a spiral screw piece that is supported from the lower end and that extends away from the lower end of the hollow tubular member, the spiral screw piece being for engagement with the ground surface, the upper end of the hollow tubular piece having an opening for receiving the object, a rotatable center piece supported about the hollow tubular member and disposed between the respective lower and upper ends of the hollow tubular member, the rotatable center piece adapted for free rotation relative to the hollow tubular member, and an elongated rod that engages with the hollow tubular member to assist in rotating the hollow tubular member and, in turn, the spiral screw piece in order to securely engage with the device with the ground surface.

7 Claims, 13 Drawing Sheets

(56) References Cited

U.S. PATENT DOCUMENTS

| | | | | |
|---|---|---|---|---|
| 2002/0066240 | A1* | 6/2002 | Chizmas | A01K 1/04 52/157 |
| 2007/0145225 | A1* | 6/2007 | Bondy | E04H 12/2223 248/530 |
| 2007/0289555 | A1* | 12/2007 | Campbell | A01K 1/04 119/786 |
| 2013/0153737 | A1* | 6/2013 | Zoeteman | E04H 12/2238 248/513 |
| 2014/0007487 | A1* | 1/2014 | Schwiebert | A45F 3/44 114/295 |
| 2018/0092333 | A1* | 4/2018 | Skinner | A01K 27/005 |
| 2018/0168125 | A1* | 6/2018 | Johnson | A45B 23/00 |
| 2019/0053588 | A1* | 2/2019 | Price | A45B 23/00 |
| 2019/0373849 | A1* | 12/2019 | Murfin | A01K 1/04 |
| 2020/0352291 | A1* | 11/2020 | Feldman | B65H 35/00 |

* cited by examiner

COMBINATION LEASH AND UMBRELLA HOLDER DEVICE

FIELD OF THE INVENTION

The present invention relates in general to an apparatus configured to be anchored to a ground surface, such as sand, dirt, or grass. The present invention is more particularly related to an apparatus configured to hold a pet leash or an umbrella, or both.

SUMMARY OF THE INVENTION

The present invention is directed to a device configured to be secured to a ground surface, and configured to have an object, such as a pet leash and/or an umbrella, secured by the device. The device includes a clip such as a carabiner, configured to secure a pet leash thereto, and a central cylindrical base that is configured to receive an umbrella if desired. The clip is fastened to a rotatable center piece that rotates 360-degrees about the center cylindrical base, such that the pet leash can rotate about the entire cylindrical base without getting tangled. The central cylindrical piece can accommodate umbrellas having various sized diameters so as to provide shade for the pet or another user, while allowing the pet to be securely tied to a surface via the device.

A device configured to be anchored to a ground surface, the device including a hollow tubular member having respective upper end and lower end, a spiral screw piece that is supported from the lower end and that extends away from the lower end of the hollow tubular member; the spiral screw piece for engagement with the ground surface, the upper end of the hollow tubular piece having an opening for receiving the object, a rotatable center piece supported about the hollow tubular member and disposed between the respective lower and upper ends of the hollow tubular member, the rotatable center piece adapted for free rotation relative to the hollow tubular member, and an elongated rod that engages with the hollow tubular member to assist in rotating the hollow tubular member and, in turn, the spiral screw piece in order to securely engage with the device with the ground surface.

In the device, it can further include a top cap that covers the opening for receiving the object. The top cap can be comprised of a two section cap construction, wherein the two section cap construction includes an outer cap and an inner cap that fits within an opening of the outer cap. The inner cap can be connected by a securing loop to the outer cap so that the inner cap can be selectively engaged with the outer cap. The inner cap and outer cap can define a central opening into which the object passes, and wherein the central opening in the outer cap can be larger than the central opening in the inner cap. The device can include a carabiner device that is attached to the rotatable center piece, the rotatable center piece is rotatable a full 360-degrees with respect to the hollow tubular member. The hollow tubular member can be configured to receive an umbrella pole at the upper end thereof.

A device for anchoring an object to a ground surface, the device including a hollow tubular member having respective upper end and lower end, a spiral screw piece that is supported from the lower end and that extends away from the lower end of the hollow tubular member, the spiral screw piece for engagement with the ground surface, the upper end of the hollow tubular piece having an opening for receiving the object, a rotatable center piece supported about the hollow tubular member and disposed between the respective lower and upper ends of the hollow tubular member, the rotatable center piece adapted for free rotation relative to the hollow tubular member, and a top cap that covers the opening at the top end of the hollow tubular piece and for receiving the object, the top cap constructed and arranged to provide multiple size openings in order to receive poles of different diameter of the object.

The device can further include an elongated rod that engages with the hollow tubular member to assist in rotating the hollow tubular member and, in turn, the spiral screw piece in order to securely engage with the device with the ground surface. The device can further include a cable that attaches one end of the elongated rod to the hollow tubular member. In the device, the elongated rod can engage through respective facing holes in the hollow tubular member, and once engaged for rotating the spiral screw piece, can be removed in order to permit the pole of the object to pass through the hollow tubular member and rest upon the spiral screw piece. In the device, the top cap can be comprised of a two section cap construction, wherein the two section cap construction includes an outer cap and an inner cap that fits within an opening of the outer cap. In the device, the inner cap is connected by a securing loop to the outer cap so that the inner cap can be selectively engaged with the outer cap. In the device, the object can be an umbrella pole. In the device, both the inner cap and outer cap can define a central opening into which the umbrella pole passes, and wherein the central opening in the outer cap can be larger than the central opening in the inner cap. The device can include a carabiner device that is attached to the rotatable center piece, the carabiner device can be configured to secure to a leash for a pet.

A device for anchoring an object to a ground surface, comprising: a hollow tubular member having respective upper end and lower end, a spiral screw piece that is supported from the lower end and that extends away from the lower end of the hollow tubular member; the spiral screw piece for engagement with the ground surface, the upper end of the hollow tubular piece having an opening for receiving the object, a rotatable center piece supported about the hollow tubular member and disposed between the respective lower and upper ends of the hollow tubular member, the rotatable center piece adapted for free rotation relative to the hollow tubular member, and a carabiner device that is attached to the rotatable center piece.

The device can include a top cap that covers the opening at the top end of the hollow tubular piece and for receiving the object; the top cap constructed and arranged to provide multiple size openings in order to receive poles of different diameter of the object. The device can further include an elongated rod that engages with the hollow tubular member to assist in rotating the hollow tubular member and, in turn, the spiral screw piece in order to securely engage with the device with the ground surface. In the device, the carabiner device can be for securing a leash to the rotatable center piece.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

In accordance with the present invention as illustrated in FIGS. 1-13, there is provided a device configured to be secured to a ground surface, and also configured to have an object, such as a pet leash and/or an umbrella, secured by the device. The device includes a clip such as a carabiner, configured to secure a pet leash thereto, and a central cylindrical base that is configured to receive an umbrella if desired. The clip is fastened to a rotatable center piece that rotates 360-degrees about the center cylindrical base, such that the pet leash is able to rotate about the entire cylindrical base without getting tangled. The umbrella may, for example, be a large beach-style umbrella that provides shade from sun or rain or other elements. The central cylindrical piece is able to accommodate umbrellas having various sized diameters so as to provide shade for the pet or another user, while allowing the pet to be securely tied to a surface via the device.

Figure 1:
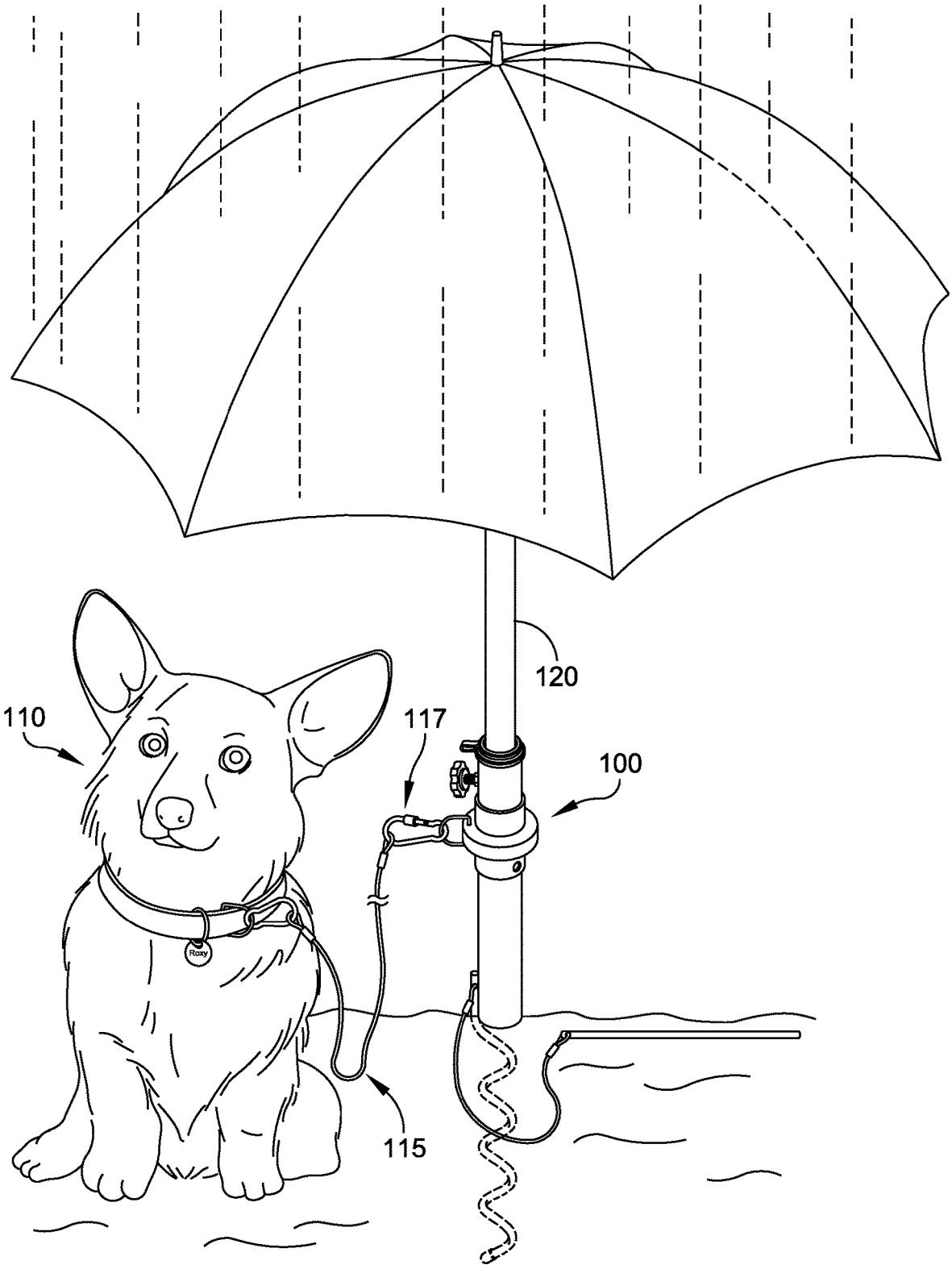
FIG. 1 is a perspective view showing a dog underneath an umbrella and out of the rain, attached to a device configured to be secured to a ground surface, according to the present disclosure.

Reference is made to FIG. 1 a perspective view showing a dog 110 underneath an umbrella and out of the rain, attached to a device 100 configured to be secured to a ground surface, according to the present disclosure. The device 100 includes a clip 117, such as a carabiner clip, configured to receive a lead 115 that a dog 110 or another animal, person, or object can be secured to. The device 100 is also configured to receive an umbrella pole 120, which serves to provide shade or protection for the pet from rain, as shown. The lead 115 is shown as having one crimped end that is secured to the carabiner 117, however any appropriate lead or leash can be secured to the clip 117, as will be appreciated.

Figure 2:
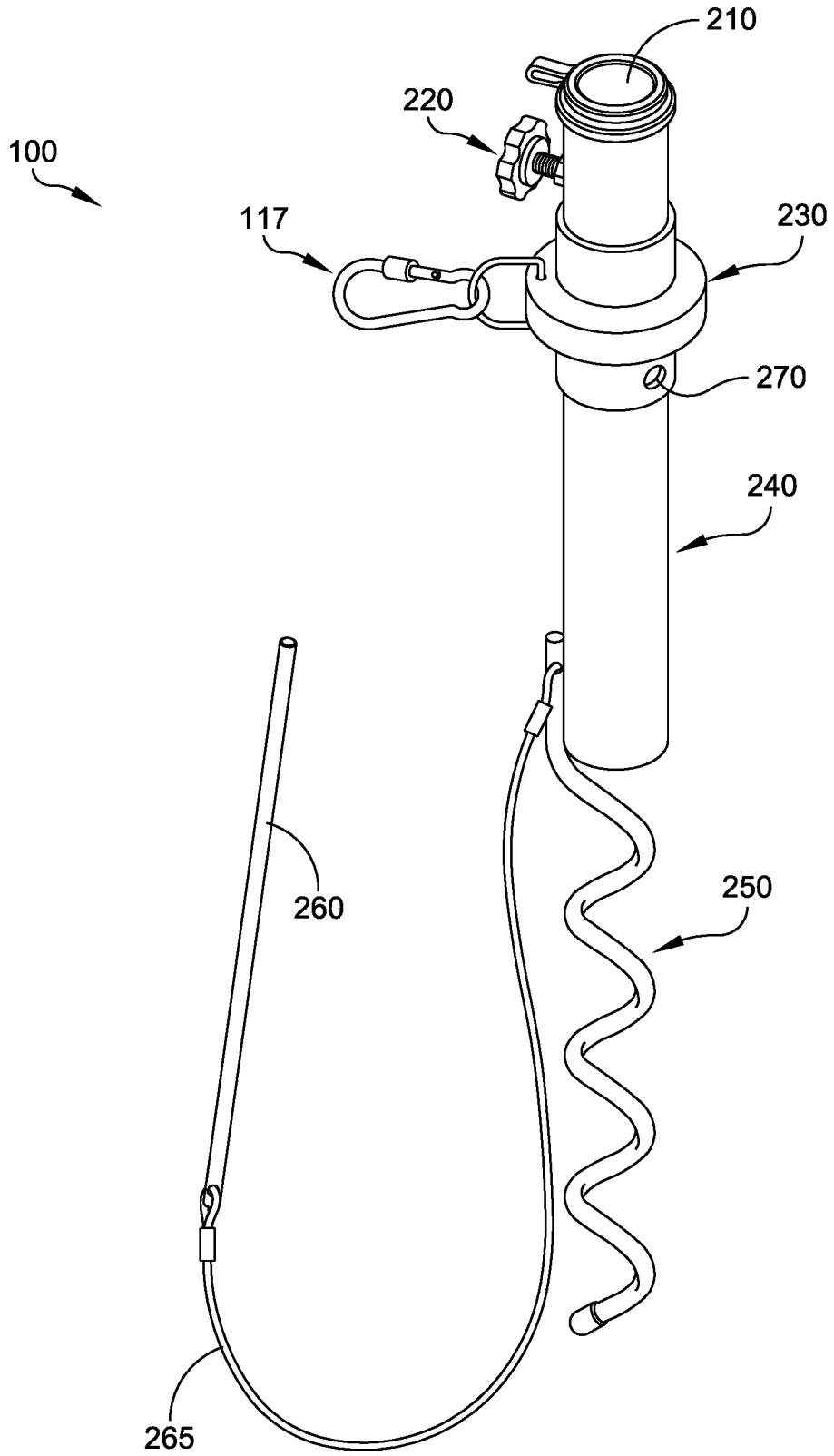
FIG. 2 is a perspective view of the device, according to the present disclosure.
Figure 12:
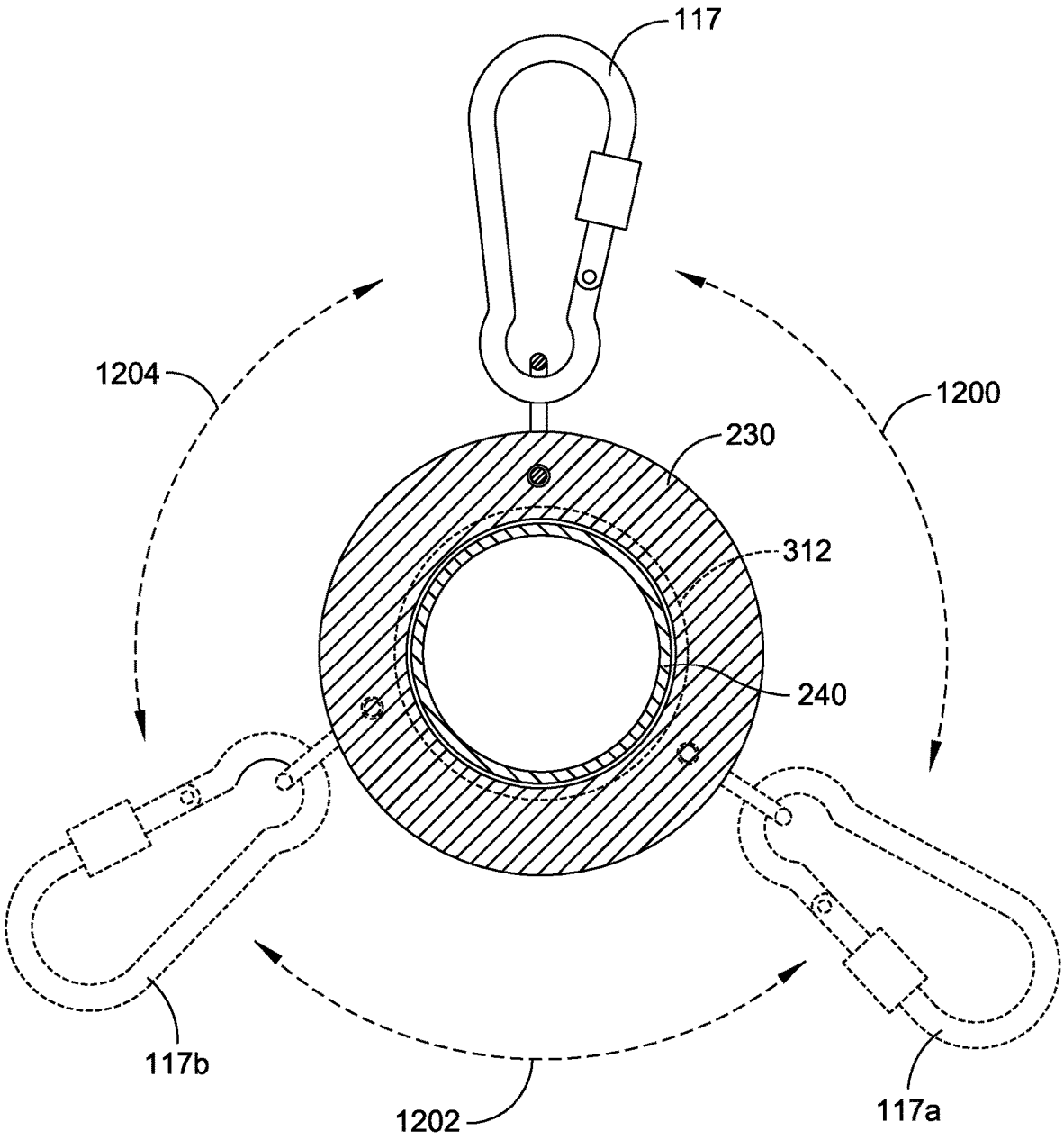
FIG. 12 is a cross-sectional view as taken along lines 12-12 of FIG. 11, showing the 360-degrees of rotation of the rotatable center piece, according to the present disclosure.

FIG. 2 is a perspective view of the device, according to the present disclosure. The device 100 includes a top cap 210 that can be open in the center so that an umbrella of smaller diameter can be inserted through a center thereof. In some embodiments, the top cap 210 may have a closed center to protect the hollow tubular member 240 from exterior contaminants such as dirt or sand. The sealed hollow tubular member in that instance may also be used to store items, such as dog waste bags. The knob 220 is shown, which is adjustable for securing an umbrella pole when inserted in the device 100, which is shown for example in FIG. 5 as engaging with the umbrella pole. Returning to FIG. 2, the device 100 includes a rotatable center piece 230 having the carabiner clip 117 secured thereto. The rotatable center piece 230 can be in the form of a disc that rotates 360-degrees about a center shaft 240. Refer to FIG. 12 for a detailed illustration of the 360-degrees of rotation of the center piece 230 about the center shaft 240. The center shaft 240 may be referred to herein as a hollow tubular piece or a hollow tubular member.

Figure 6:
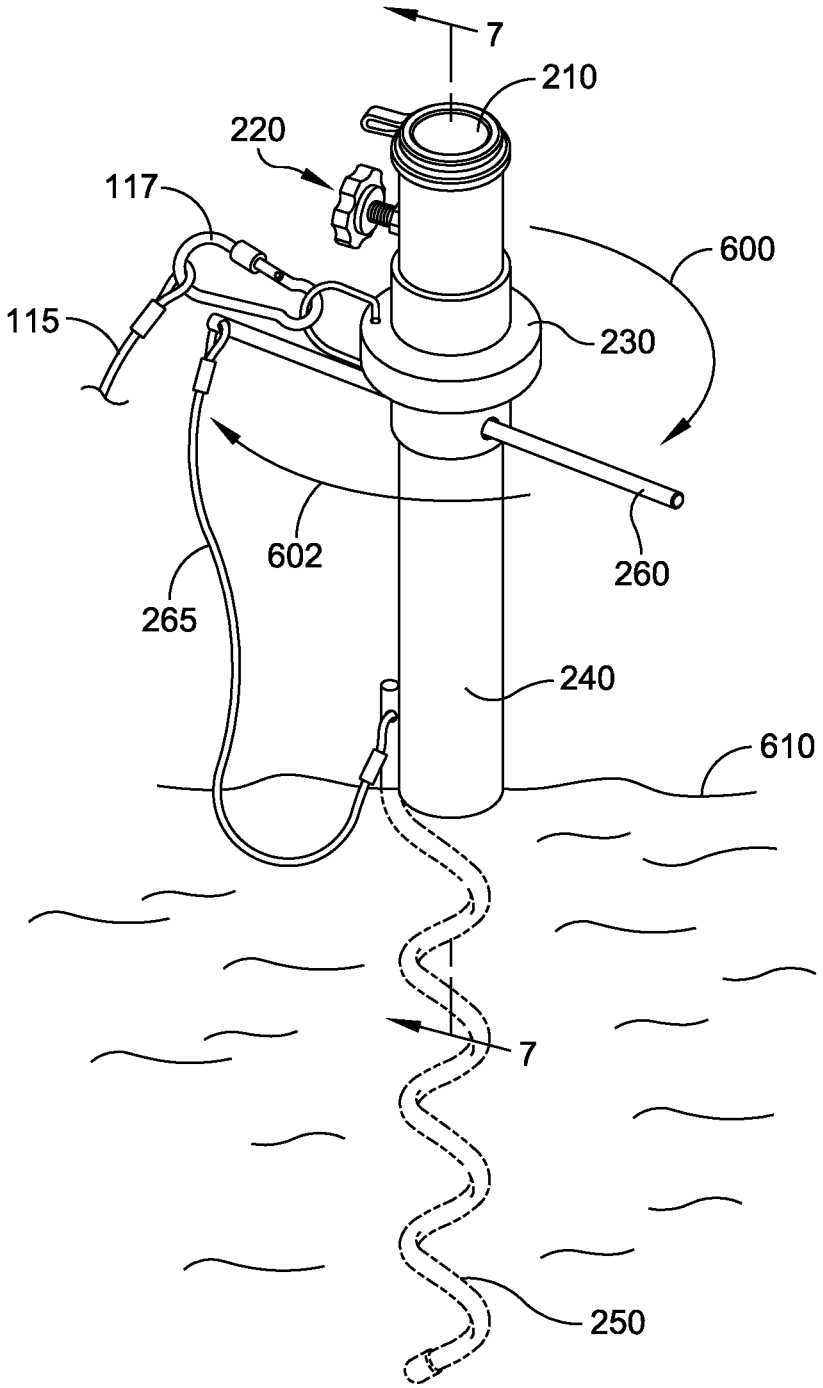
FIG. 6 is a perspective view of the device showing the elongated rod in place, with arrows showing rotation of turn of the elongated rod to screw the device into a ground surface, according to the present disclosure.

Referring back to FIG. 2, the device 100 includes a spiral screw piece 250 that is used to secure or otherwise tie the device down to a ground surface. The device 100 further includes an elongated rod 260 that can be secured to the device 100 by a lead 265. The elongated rod 260 is configured to be placed through the through-hole 270 and is used to tie the device 100 down into a ground surface. Refer, for example, to FIG. 6 illustrating the rotational movement of the elongated rod 260 to secure the device 100 to a ground surface 610. Referring back to FIG. 2, the through-hole 270 is on opposing sides of the cylindrical center shaft 240 so that, when engaged, the elongated rod 260 extends fully through the center shaft 240.

Figure 3:
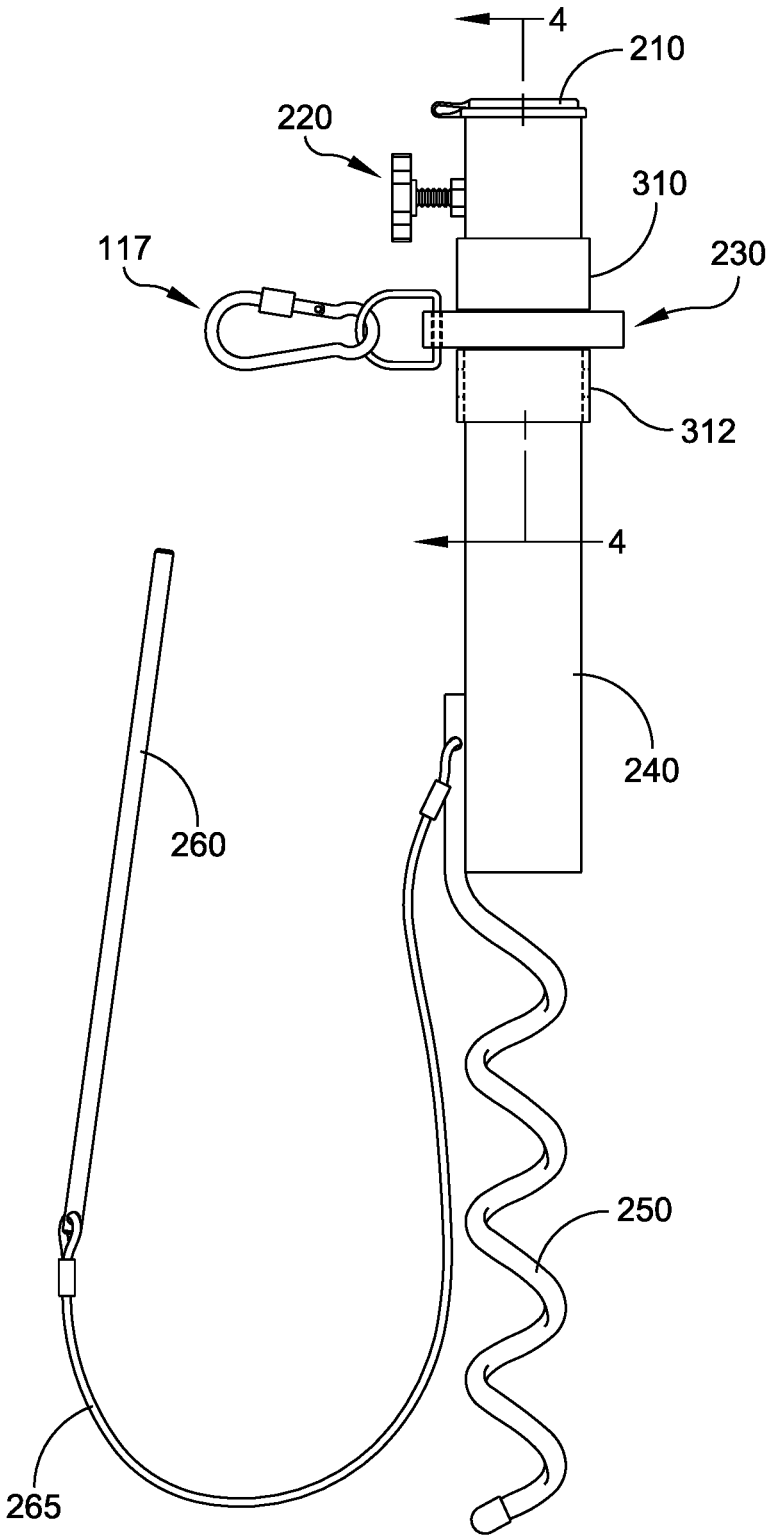
FIG. 3 is a side view of the device, according to the present disclosure, with the pet and pet leash lead removed to show the device in greater detail.

FIG. 3 is a side view of the device, according to the present disclosure, with the pet and pet leash lead removed to show the device in greater detail. The device can include an upper support member or brace 310 and a lower support member or brace 312. The upper brace 310 and lower brace 312 can form a track for the rotatable center piece 230 to rotate about the shaft 240. The rotatable center piece 230 rotates about the center shaft 240 at the joining spot of the upper brace 310 and the lower brace 312. The upper brace and lower brace can provide additional rigidity to the shaft 240 as well as a securing anchor point for the rotatable center shaft 230.

Figure 4:
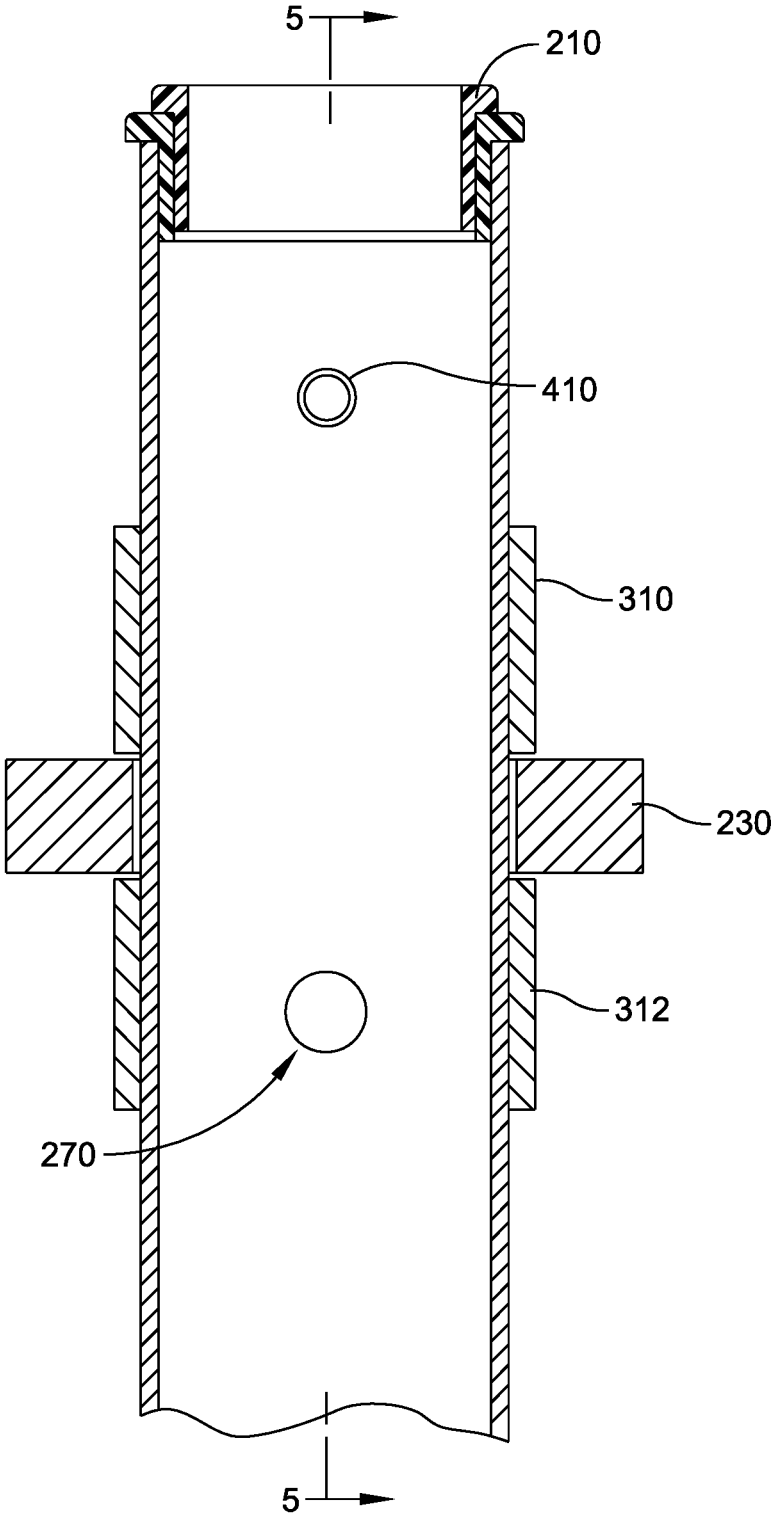
FIG. 4 is a cross-sectional view as taken along lines 4-4 of FIG. 3, showing the rotatable center piece having a space to rotate 360-degrees with respect to the center pole member of the device.

FIG. 4 is a cross-sectional view as taken along lines 4-4 of FIG. 3, showing the rotatable center piece having a space to rotate 360-degrees with respect to the center pole member of the device. In the cross-sectional view of FIG. 4, the hole 410 is visible, which is configured to receive a screw of the knob 220. The through-hole 270 that receives the elongated rod 260 is visible in this cross-sectional view.

Figure 5:
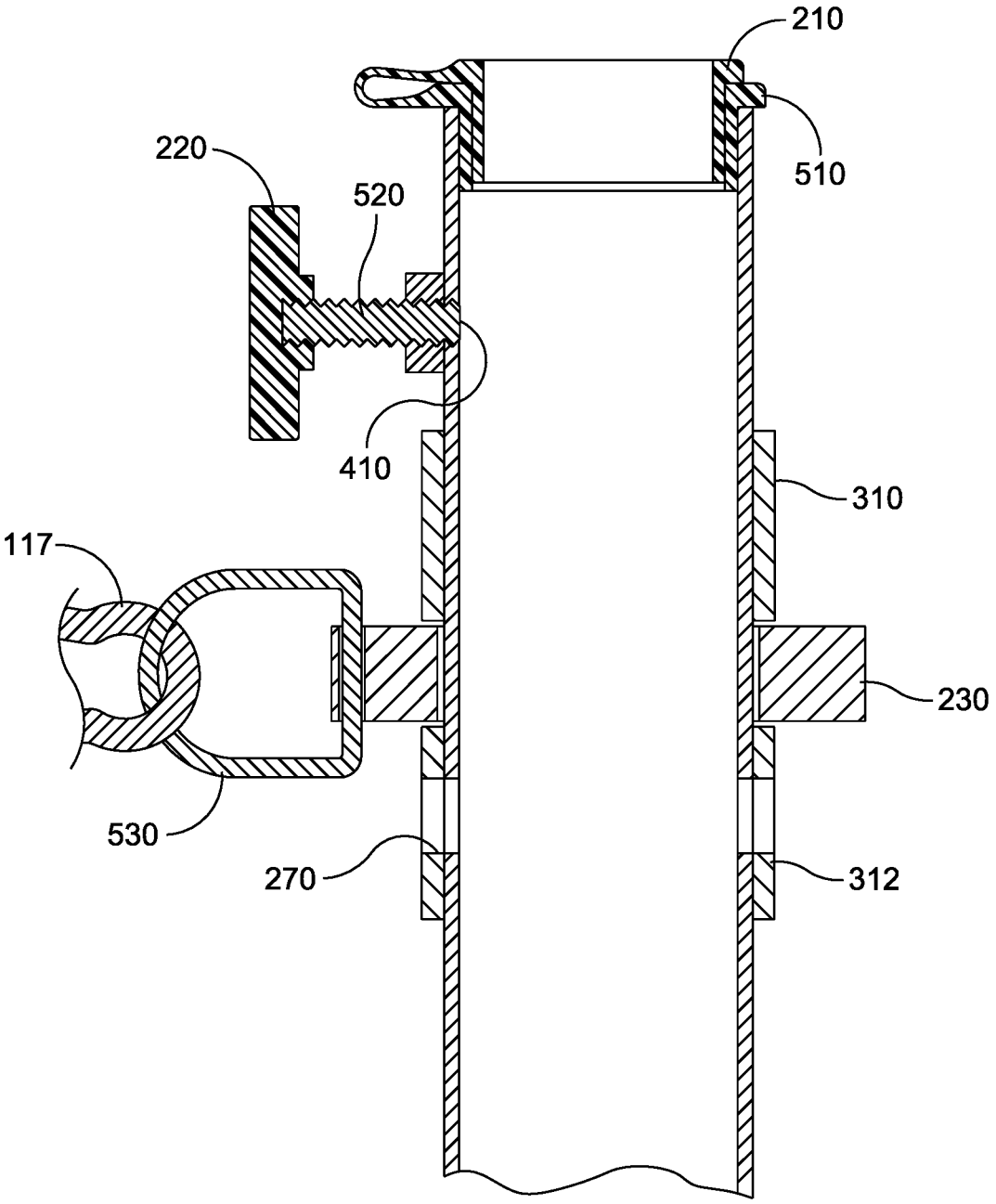
FIG. 5 is a cross-sectional view as taken along lines 5-5 of FIG. 4, illustrating the knob and screw that are configured to hold the umbrella (not shown) in place, as well as the rotatable center piece and the hole for receiving the elongated pole (not shown) that assists in screwing the device into a ground surface.

FIG. 5 is a cross-sectional view as taken along lines 5-5 of FIG. 4, illustrating the knob 220 and screw 520 that are configured to hold the umbrella (not shown) in place, as well as the rotatable center piece 230 and the hole for receiving the elongated pole (not shown) that assists in screwing the device into a ground surface. The inner cap 210 is shown as received within an outer cap portion 510. The inner cap portion 210 has an outer diameter that is approximately the same as the inner diameter of the outer cap portion 510 such that there is a secure snap-fit of the inner cap portion 210 within the outer cap portion 510. The inner cap portion 210 and the outer cap portion 510 may be referred to herein together as a two section cap construction. As shown, the inner cap 210 can be connected to the outer cap 510 by a securing loop 512 so that the inner cap 210 can be selectively engaged with the outer cap 510. The securing loop 512 enables the inner cap 210 to be essentially attached to the outer cap portion 510 even in the position illustrated in FIG. 10.

Figure 9:
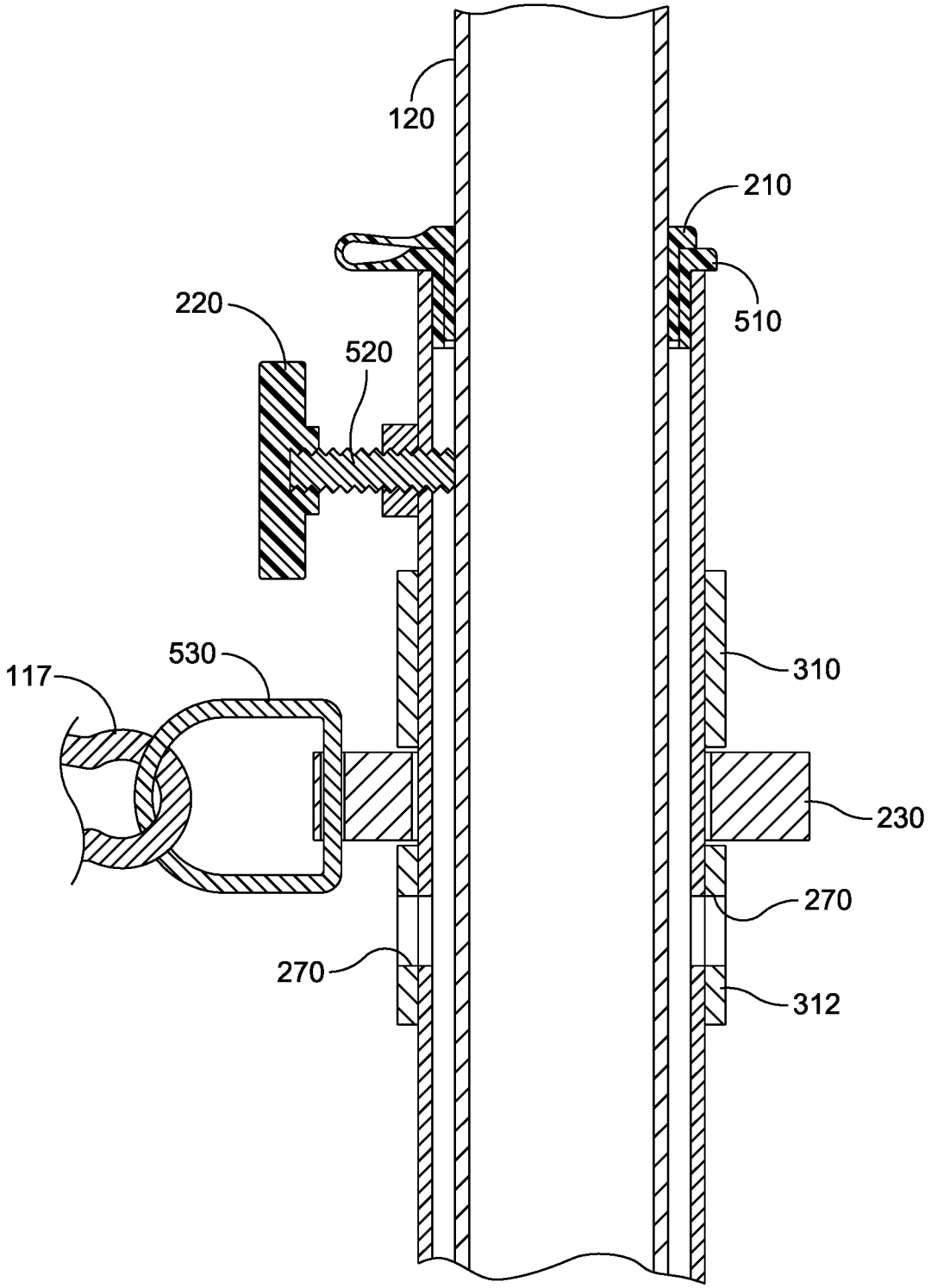
FIG. 9 is a cross-sectional view similar to FIG. 8, but with the elongated rod removed, and showing an umbrella pole inserted within the cylindrical base, according to the present disclosure.
Figure 10:
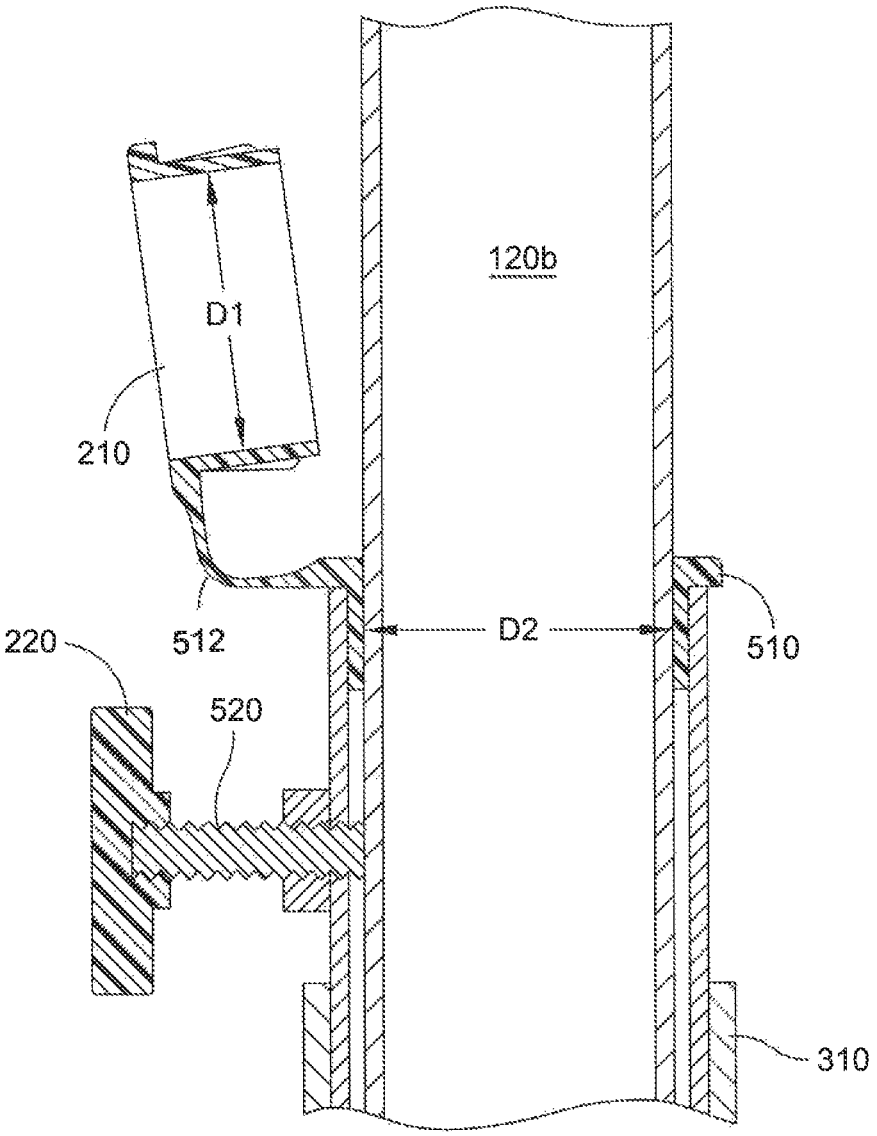
FIG. 10 is a cross-sectional view similar to FIG. 9, but showing a second, larger-sized diameter pole inserted within the cylindrical base, and the inner top cap portion removed, according to the present disclosure.

The knob 220 includes a screw portion 520 that is received through the hole 410 and is configured to engage with an umbrella pole (refer, for example, to FIGS. 9 and 10 showing, respectively, the screw engaged with a first and second size diameter umbrella pole). Referring back to FIG. 5, the clip 117 can be secured to the rotatable center piece 230 by an appropriate fastener 530, such as a D-clip, C-clip, carabiner style clip, or other appropriate fastener, as will be appreciated.

FIG. 6 is a perspective view of the device 100 showing the elongated rod 260 in place, with arrows 600, 602 showing rotation of turn of the elongated rod 260 to screw the device into a ground surface 610, according to the present disclosure. The device 100 is secured to the ground surface 610 by twisting the rod 260 clockwise in the direction of arrows 600, 602, to thereby secure the spiral screw piece into the ground surface 610. After the device is screwed into the surface, the elongated rod 260 can be removed, so that it does not interfere with the rotatable center piece 230, the clip 117, or the lead or leash 115. When desired to remove the device 100 from the ground surface 610, the elongated pole 260 can be re-inserted and then turned counter-clockwise in the direction opposite to arrows 600, 602, to remove the device from the ground surface.

Figure 7:
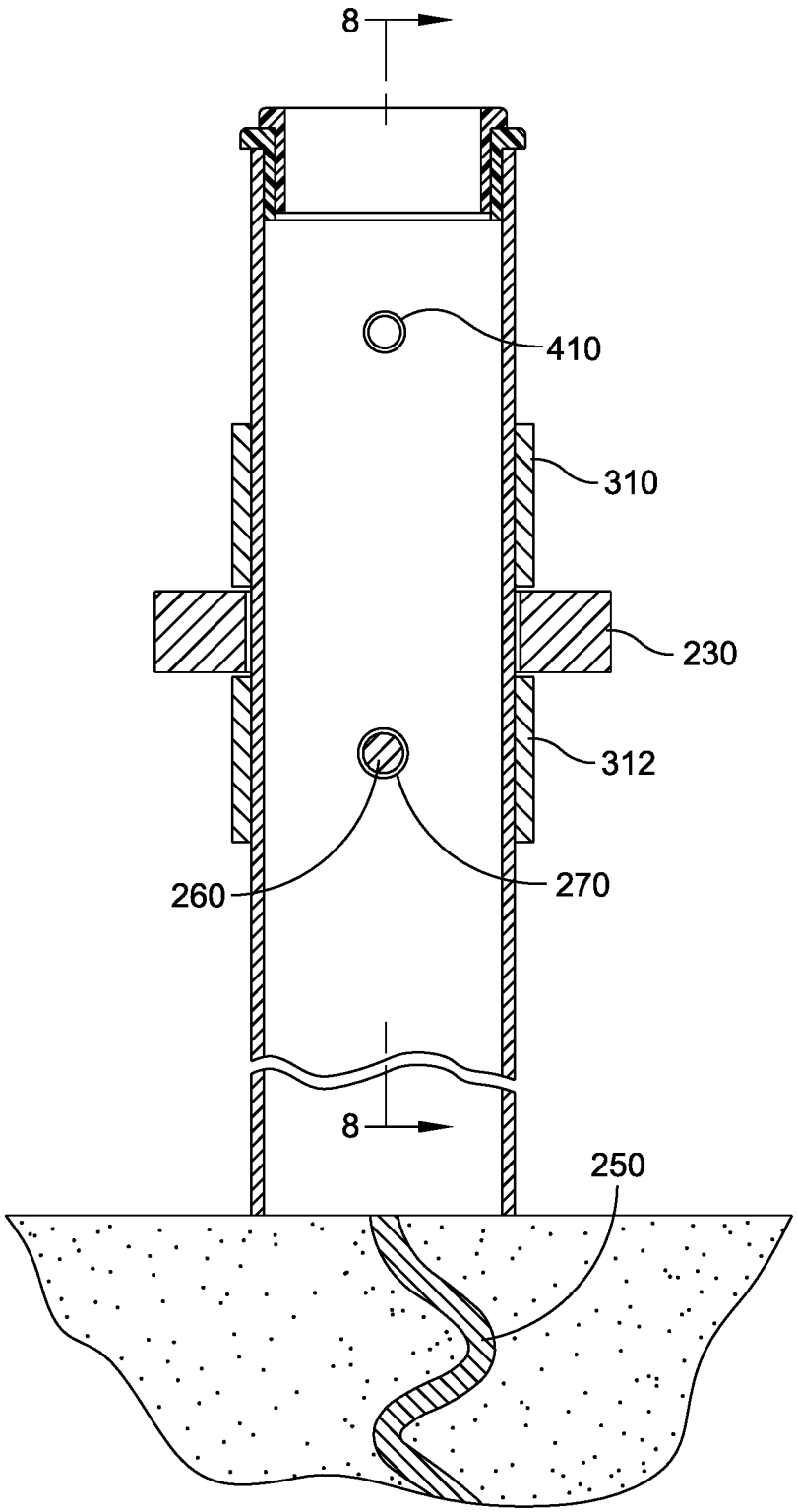
FIG. 7 is a cross-sectional view as taken along lines 7-7 of FIG. 6, showing the elongated rod in place in the cylindrical base, and the device fully anchored into the ground surface, according to the present disclosure.

FIG. 7 is a cross-sectional view as taken along lines 7-7 of FIG. 6, showing the elongated rod 260 in place, extending through the opening 270 in the hollow tubular member, and the device fully anchored into the ground surface, according to the present disclosure. The hole 410 for receiving the screw 520 is also visible in this cross-sectional view.

Figure 8:
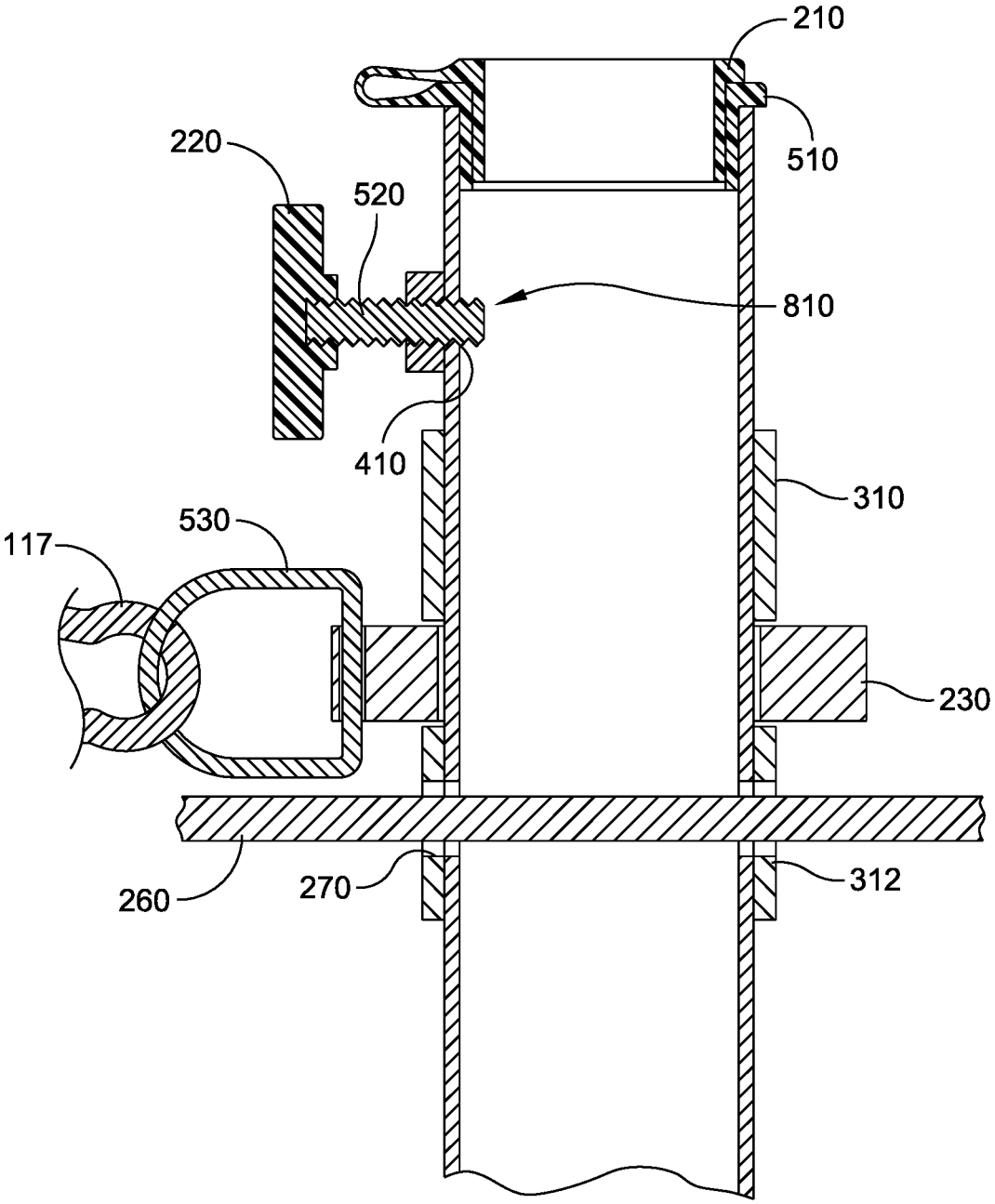
FIG. 8 is a cross-sectional view as taken along lines 8-8 of FIG. 7, showing the elongated rod as fully inserted through the cylindrical base.

FIG. 8 is a cross-sectional view as taken along lines 8-8 of FIG. 7, showing the elongated rod 260 as fully inserted through the opening 270 in the cylindrical base 240. Note at 810 that the knob 220 has been turned sufficiently so as to partially tighten the screw 520 within the shaft 240. This allows the screw to interface with an umbrella pole, for example as shown in FIGS. 9-10.

FIG. 9 is a cross-sectional view similar to FIG. 8, but with the elongated rod 260 removed, and showing the umbrella pole 120 inserted within the cylindrical shaft 240, according to the present disclosure. Note that the screw 520 is tightened (i.e., drawn inward) to contact the pole 120 and secure the pole 120 within the hollow tubular member 240 of the device 100.

FIG. 10 is a cross-sectional view similar to FIG. 9, but showing a second, larger-sized diameter umbrella pole **120*b* inserted within the cylindrical base. Note that the inner top cap portion 210 has been removed, and the pole 120*b* is received within the outer pole portion 510. Note that the screw 520 has been backed out or loosened (as compared to FIG. 9) to come into contact with the pole 120*b*. FIG. 10** also illustrations at D1 the smaller diameter aperture and at D2 the larger diameter aperture for accommodating a larger diameter umbrella pole.

Figure 11:
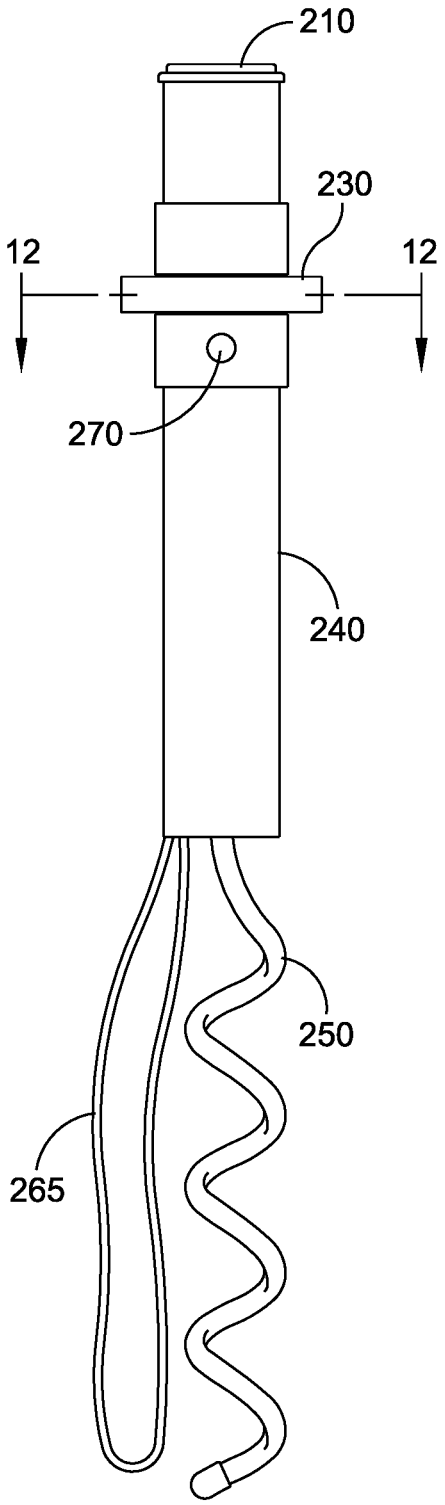
FIG. 11 is a side view showing the second side of the device, illustrating the opening through which the elongated rod extends, according to the present disclosure.

FIG. 11 is a side view showing the second side of the device, illustrating the opening 270 through which the elongated rod (260, not shown in FIG. 11) extends, according to the present disclosure.

FIG. 12 is a cross-sectional view as taken along lines 12-12 of FIG. 11, showing the 360-degrees of rotation of the rotatable center piece, according to the present disclosure. The carabiner clip 117 has 360-degrees of movement with respect to the hollow tubular member 240, by its attachment to the rotatable center piece 230. As shown, the arrows 1200, 1202, 1204 show the 360-degrees of movement in either direction of the carabiner clip 117. Three possible positions of the clip are illustrated at 117, **117*a*, and 117*b*, however there are any number of infinite possible positions of the clip 117 at 360-degrees of rotation with respect to the shaft 240**, as will be appreciated in light of the present disclosure.

Figure 13:
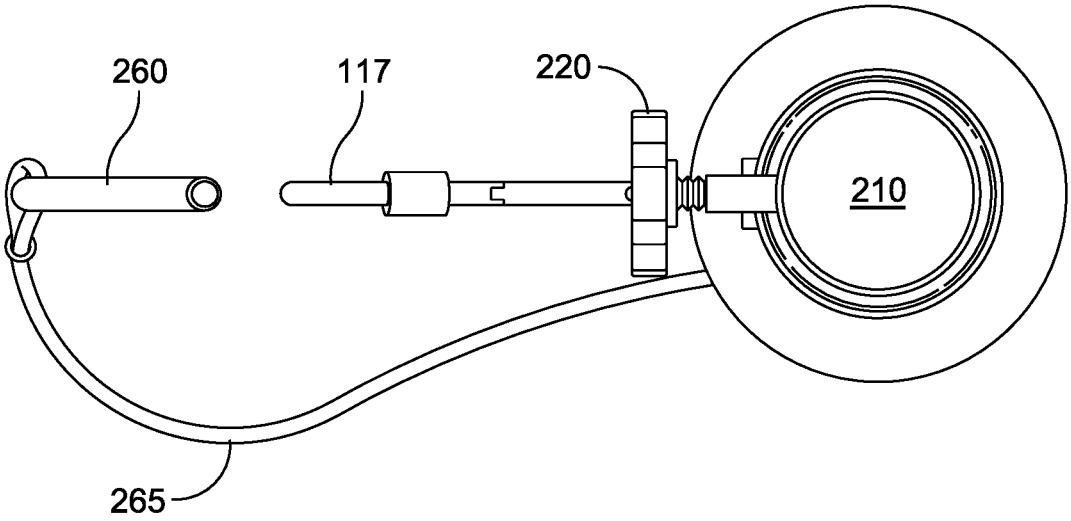
FIG. 13 is a top view of the device, according to the present disclosure.

FIG. 13 is a top view of the device, according to the present disclosure. The top or inner cap portion 210, the knob 220, the clip 117, the elongated rod 260, and the lead 265 are visible in the top view.

It will be appreciated that although certain embodiments of the present disclosure have been shown and described, it will be appreciated that other modifications and enhancements can be made within ordinary skill, such as fastening other objects or individuals to the device for securing them thereto, such as other animals including but not limited to cats, ferrets, or any animal that can be put on a leash, or in some cases, if desired, a small child or toddler can be placed on the lead. Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A device for anchoring a beach umbrella to a ground surface of sand or dirt, said device also for securing an animal in position relative to the ground surface, said device comprising:

a hollow tubular member having respective upper end and lower end;

a spiral screw piece that is supported from the lower end and that extends away from the lower end of the hollow tubular member;

the spiral screw piece for engagement into the ground surface;

an umbrella pole;

the upper end of the hollow tubular piece having an opening for telescopically receiving the umbrella pole;

a rotatable center piece supported about the hollow tubular member and disposed between the respective lower and upper ends of the hollow tubular member;

the rotatable center piece adapted for free rotation relative to the hollow tubular member;

a pair of spaced apart upper and lower support collars that are disposed about the hollow tubular member and that define therebetween a rotation track in which the rotatable center piece rotates;

an elongated rod that engages with the hollow tubular member to assist in rotating the hollow tubular member and, in turn, the spiral screw piece in order to securely engage with the device with the ground surface;

the elongated rod extending through respective facing opposed holes in the hollow tubular member, and once engaged with the facing opposed holes for rotating the spiral screw piece, is removable in order to permit the umbrella pole to pass into the hollow tubular member;

a top cap that covers the opening at the top end of the hollow tubular piece and for receiving the umbrella pole;

a tightening screw in the side of the hollow tubular member for securing the umbrella pole in the hollow tubular member;

the tightening screw being disposed at a location over the elongated rod;

wherein the lower support collar also has facing opposed holes for receiving the elongated rod, the facing opposed holes in the lower support collar are in alignment with the facing opposed holes in the hollow tubular member; and wherein the tightening screw is disposed height wise along the hollow tubular member over both the rotatable center piece and the elongated rod.

2. The device of claim 1 wherein the top cap is constructed and arranged to provide multiple size openings in order to receive umbrella poles of different diameter.

3. The device of claim 1 wherein the top cap is comprised of a two piece cap construction, wherein the two piece cap construction includes an outer cap and an inner cap that fits within an opening of the outer cap.

4. The device of claim 3 wherein the inner cap is connected by a securing loop to the outer cap so that the inner cap can be selectively engaged with the outer cap.

5. The device of claim 4 wherein both the inner cap and outer cap define a central opening into which the umbrella pole passes, and wherein the central opening in the outer cap is larger in diameter than the central opening in the inner cap.

6. The device of claim 4 wherein the inner cap is connected by a securing loop to the outer cap so that the inner cap can be selectively engaged with the outer cap.

7. The device of claim 1 including a carabiner device that is attached to the rotatable center piece, and the rotatable center piece is rotatable a full 360-degrees with respect to the hollow tubular member.

* * * * *